United States Patent [19]

Wong et al.

[11] Patent Number: 5,061,037

[45] Date of Patent: Oct. 29, 1991

[54] DUAL SEPTUM POLARIZATION ROTATOR

[75] Inventors: Mon N. Wong; Gregory D. Kroupa, both of Torrance, Calif.

[73] Assignee: Hughes Aircraft Company, Los Angeles, Calif.

[21] Appl. No.: 600,960

[22] Filed: Oct. 22, 1990

[51] Int. Cl.[5] ..... G42B 6/00

[52] U.S. Cl. ..... 385/11

[58] Field of Search ..... 350/96.28, 96.10; 333/202, 208, 21 R, 21 A

[56] References Cited

U.S. PATENT DOCUMENTS

| | | | |
|---|---|---|---|
| 4,546,359 | 10/1985 | Bui-Hai | 333/21 A |
| 4,762,384 | 8/1988 | Hegarty et al. | 350/96.12 |
| 4,850,665 | 7/1989 | Whitehead | 350/96.10 |
| 4,952,014 | 8/1990 | Lieberman et al. | 350/96.12 |

*Primary Examiner*—Frank Gonzalez

*Attorney, Agent, or Firm*—Robert A. Westerlund; Steven M. Mitchell; Wanda K. Denson-Low

[57] ABSTRACT

A dual septum polarization rotator which, in the presently preferred embodiment thereof, includes a square waveguide and a pair of stepped septums disposed in spaced, orthogonal relation to each other within opposite end portions of the square waveguide. A first one of the septums extends horizontally between the side walls of the waveguide, parallel to the top and bottom walls of the waveguide, and the other/second one of the septums extends vertically between the top and bottom walls of the waveguide, parallel to the side walls of the waveguide. The first septum, in cooperation with the waveguide, defines first and second input ports, and, the second spectum, in cooperation with the waveguide, defines first and second output ports. The spacing between the first and second septums defines a central, open, nonseptum region within the waveguide. In operation, the first septum functions to convert the polarization of a first excitation signal introduced into the first input port from a first polarization to a second polarization, and the second septum functions to convert the second polarization into a third polarization orthogonal to the first polarization, for output, via the first output port, as a first output signal. For example, if the first polarization is horizontal polarization, then the second polarization is circular polarization, and the third polarization is vertical polarization. The polarization rotator of the present invention is also capable of dual mode operation, whereby the polarization of a second excitation signal introduced into the second input port is simultaneously rotated for output, via the second output port, as a second output signal.

20 Claims, 3 Drawing Sheets

FIG. I.
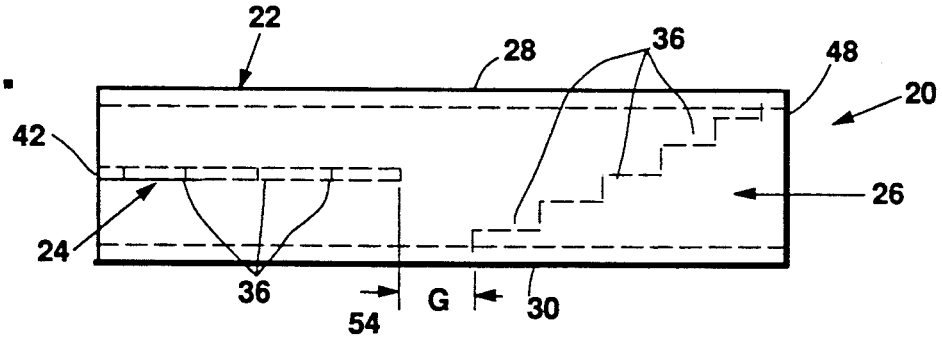
FIG. 2.
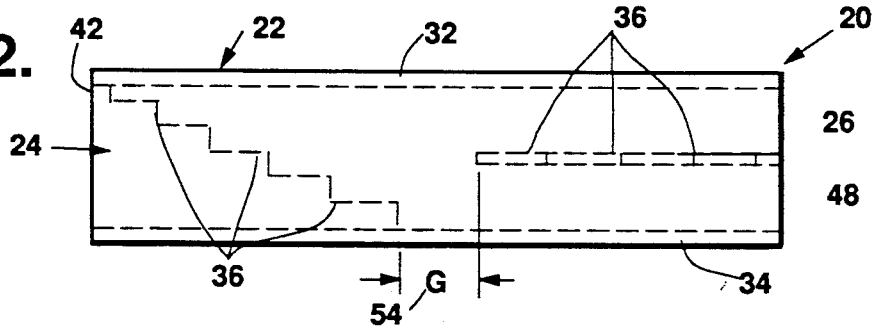
FIG. 3.
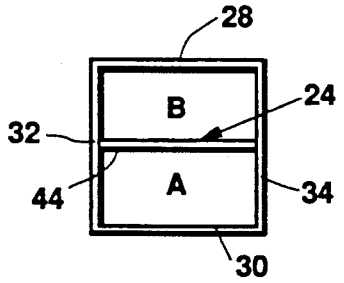
FIG. 4.
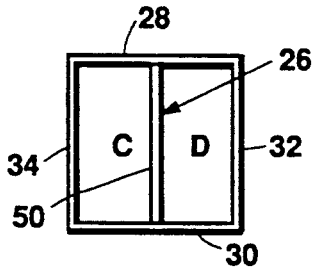

DUAL SEPTUM POLARIZATION ROTATOR

FIELD OF THE INVENTION

The present invention relates generally to waveguide devices for rotating the plane of polarization of an input signal applied thereto, and more particulary, to a dual septum polarization rotator which is of novel design and architecture, and which affords significant advantages in performance, capabilities, cost, size, and manufacturability, relative to presently available waveguide devices of this general type. It is presently contemplated that the dual septum polarization rotator of the present invention will have particular utility in power division, signal distribution, beam forming, beam steering/scanning, and signal feed networks, e.g., such as are employed in phased array antenna systems utilized in communications satellites.

BACKGROUND OF THE INVENTION

Presently available waveguide devices for rotating the plane of polarization of an input signal applied thereto are unduly complex to manufacture and are unduly cumbersome for most applications. In certain applications, such as spaceborne satellite applications, where space is at a premium, and large numbers of these devices may be required, the size, weight, and manufacturability of these devices becomes a major consideration and design constraint, especially as the satellite antenna designs become increasingly complex and expensive.

More particularly, presently available waveguide devices of this type are comprised of various discrete sections or segments of waveguide which are mated together in such a manner as to provide physical/mechanical waveguide twists and turns/bends in order to effectuate rotation of the plane of polarization of an input signal applied thereto. Alternatively, presently available waveguide-type polarization rotators include mechanisms for physically/mechanically rotating waveguide sections relative to each other in order to effectuate rotation of the plane of polarization of an input signal applied thereto. Not only are these presently available waveguide-type polarization rotators encumbered by the limitations and shortcomings discussed above, but they also suffer from degraded electrical performance (e.g. due to RF mismatch and reflection losses at the coupling of the various waveguide sections), and lack of dual mode capability.

The present invention substantially eliminates and overcomes these shortcomings and limitations of these presently available waveguide-type polarization rotators.

SUMMARY OF THE INVENTION

The present invention encompasses a dual septum polarization rotator which includes a hollow, electrically conductive waveguide and a pair of septums disposed in spaced, orthogonal relation to each other within opposite end portions of the waveguide. The waveguide is of a type capable of supporting signal propagation of circular and linear polarizations, and preferably comprises a square waveguide. A first one of the septums defines, in cooperation with the waveguide, first and second input ports, and the other/second one of the septums defines, in cooperation with the waveguide, first and second output ports. The first septum is adapted to convert the polarization of a first excitation signal applied to the first input port from a first polarization to a second polarization, e.g., from a linear to a circular polarization. The second septum is adapted to convert the polarization of the first excitation signal from the second polarization to a third polarization orthogonal to the first polarization, for output, via the first output port, as a first output signal. For example, if the first polarization is horizontal polarization, then the second polarization is circular polarization, and the third polarization is vertical polarization.

In a presently preferred embodiment of the present invention, the first septum extends horizontally across the interior of the waveguide between the side walls of the waveguide, parallel to the top and bottom walls of the waveguide and, the second septum extends vertically across the interior of the waveguide between the top and bottom walls of the waveguide, parallel to the side walls of the waveguide. The first and second septums are spaced-apart to define an open, central, nonseptum region in the waveguide. The horizontal dimension of the first and second septums decreases in a direction from the outside of the waveguide towards the nonseptum region of the waveguide. Most preferably, the first and second septums each comprise a stepped septum having a plurality of steps which descend in the direction in which the horizontal dimension of the septum decreases. Additionally, the polarization rotator of the instant invention is capable of dual mode operation, whereby the rotator functions simultaneously to rotate the polarization of a second excitation signal applied to the second input port in essentially the same manner as it functions to rotate the polarization of the first excitation signal applied to the first input port, for output, via the second output port, as a second output signal having a polarization orthogonal to the original polarization of the second excitation signal. The first and second output signals preferably have E-field vectors which are pointed in opposite directions, to thereby enable the rotator to operate in the same frequency band for both signals, with excellent isolation and low return loss. The first and second excitation signals are preferably microwave signals in the same frequency band, e.g., the Ku frequency band.

It should be appreciated that the polarization rotator of the present invention is much more compact and much easier to fabricate than currently available waveguide-type devices of this type, and further, that the polarization rotator of the present invention provides dual mode capability and superior electrical performance.

BRIEF DESCRIPTION OF THE DRAWINGS

The various features and advantages of the present invention may be more readily understood with reference to the following detailed description taken in conjunction with the accompanying drawings, wherein like reference numerals and characters designate like elements, and in which:

FIG. 1 is a side view of a presently preferred embodiment of the dual septum polarization rotator of the instant invention.

FIG. 2 is a top view of the rotator shown in FIG. 1.

FIG. 3 is an end view of the horizontal septum portion of the rotator shown in FIGS. 1 and 2.

FIG. 4 is an end view of the vertical septum portion of the rotator shown in FIGS. 1 and 2.

DETAILED DESCRIPTION OF THE INVENTION

Figure 5:
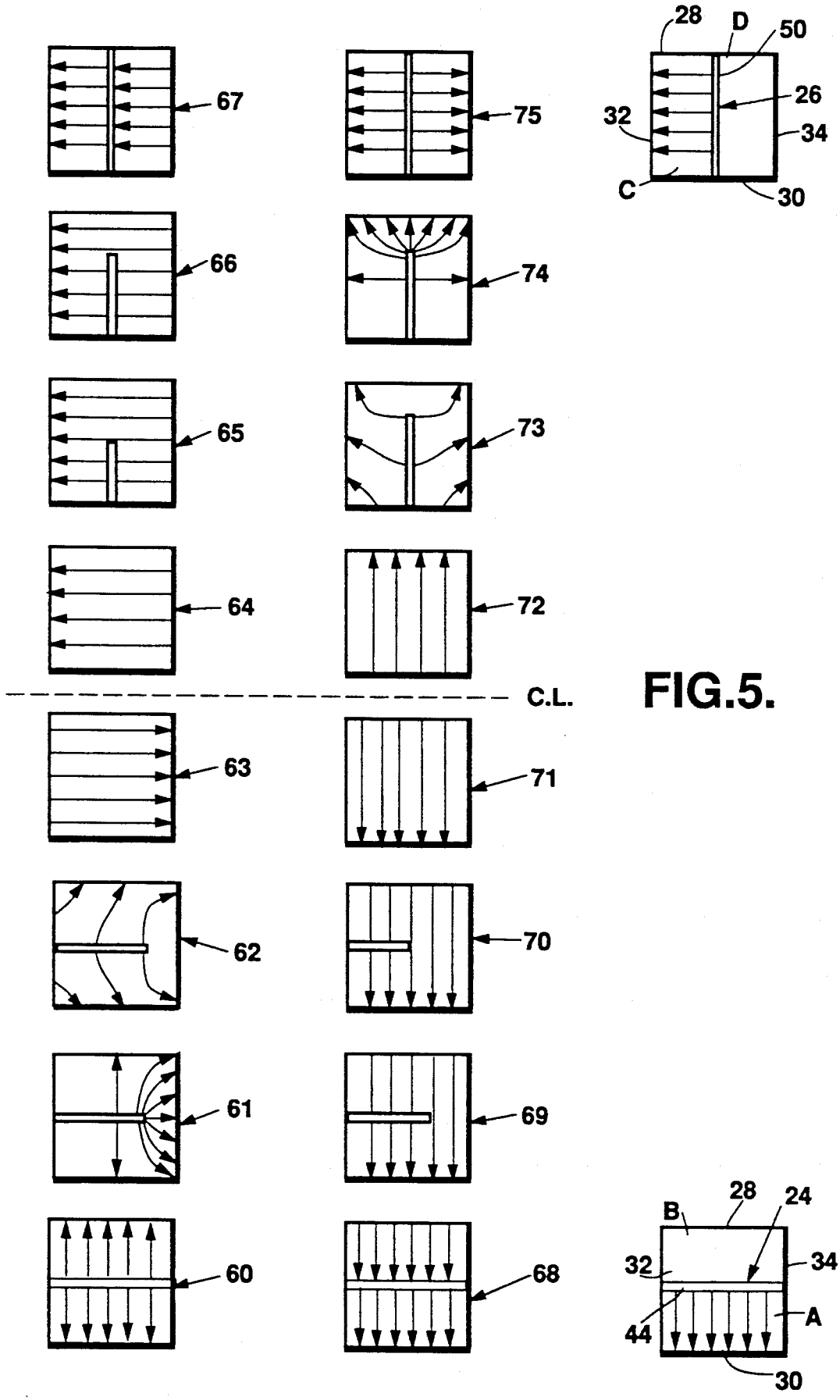
FIG. 5 illustrates the electric field vectors of a vertically polarized signal introduced into the input port A of the rotator shown in FIGS. 1 and 2, in successive planes spaced along and perpendicular to the longitudinal axis of the rotator waveguide, corresponding to successive stages of progression of the signal as it propagates through the rotator waveguide from input port A towards output port C.

Referring now to FIGS. 1–4, there can be seen a dual septum polarization rotator 20 which constitutes a presently preferred embodiment of the instant invention. The polarization rotator 20 is comprised of a hollow, electrically conductive waveguide 22 having a square cross-section, which will hereinafter be referred to as the square waveguide 22, and a pair of stepped septums 24, 26 disposed in spaced, orthogonal relation to each other within opposite end portions of the square waveguide 22.

The waveguide 22 is comprised of electrically conductive top and bottom walls 28, 30 joined together by opposite, electrically conductive side walls 32, 34, respectively. Of course, as is well-known in the art, a square waveguide operating in its fundamental transverse electric mode will support signal propagation of any polarization, including circular.

The stepped septums 24, 26 are made of electrically conductive material, and are each provided with a plurality of, e.g. four, steps 36 descending in the direction from the outside of the waveguide 22 towards the central interior of the waveguide 22. The steps 36 are preferably of substantially uniform size. The septum 24 extends horizontally across the hollow interior of the waveguide 22 between the opposite side walls 32, 34 thereof, and parallel to the top and bottom walls 28, 30 thereof. A marginal edge portion 42 of the septum 24 adjacent to the endmost edge 44 thereof, is the only portion of the septum 24 which actually spans the internal width of the waveguide 22 to interconnect the opposite side walls 32, 34, preferably halfway between the top and bottom walls 28, 30, to thereby provide vertically adjacent, rectangular input ports A, B, having preferably equal dimensions. The septum 26 extends vertically across the hollow interior of the waveguide 22 between the top and bottom walls 28, 30 thereof, and parallel to the opposite side walls 32, 34 thereof. A marginal edge portion 48 of the septum 26 adjacent to the endmost edge 50 thereof, is the only portion of the septum 26 which actually spans the internal height of the waveguide 22 to interconnect the top and bottom walls 28, 30, preferably halfway between the opposite side walls 32, 34, to thereby provide horizontally adjacent, rectangular output ports C, D, having preferably equal dimensions. For the sake of facilitating ease of discussion, the septum 24 will hereinafter be referred to as the horizontal septum, and the septum 26 will hereinafter be referred to as the vertical septum.

The waveguide 22 can be considered as having three internal portions: (1) a horizontal septum portion defined as that region where a cross-section of the waveguide 22 cuts the horizontal septum 24; (2) a vertical septum portion defined as that region where a cross-section of the waveguide 22 cuts the vertical septum 26; and, (3) a central, non-septum portion 54 spanning the gap G between the horizontal septum 24 and the vertical septum 26.

In operation, the dual septum polarization rotator 20 of the present invention functions to rotate the plane of polarization of a first polarized microwave input signal introduced into the input port A, by 90°, and/or to rotate the plane of polarization of a second polarized microwave input signal introduced into the input port B, by 90°. For the sake of facilitating ease of explanation of the operation of the present invention, it will be assumed that the first input signal is vertically polarized, and that the second input signal is also vertically polarized, although it should be clearly understood that the invention functions in the same manner with polarized signals of any orientation. In general terms, these results are obtained in the following manner. First, the horizontal septum 24 functions in a manner equivalent to a combined orthomode transducer/polarizer to convert a vertically polarized microwave input signal applied to input port A into a left-hand circularly polarized signal (LHCP signal). The LHCP signal then passes through the central, non-septum portion 54 of the waveguide 22, which is $\frac{1}{2}$ WV long in the direction of propagation of the signal, where WV is the free-space wavelength (i.e. the wavelength in an unbounded medium) of the center frequency, $f_c$, of the input signal band. Thus, the LHCP signal is allowed to make a half-rotation as it passes through the non-septum portion 54, which causes an inversion of the orthogonal electric field components, $E_x$ and $E_y$, of the LHCP signal. Thenceforth, the vertical septum 26 functions in a manner equivalent to a combined orthomode transducer/polarizer to convert the LHCP signal into a horizontally polarized signal which is outputted via output port C. Similarly, the horizontal septum 24 functions in a manner equivalent to a combined orthomode transducer/polarizer to convert a vertically polarized signal applied to input port B into a right-hand circularly polarized (RHCP) signal. The RHCP signal then passes through the non-septum portion 54 of the waveguide 22, where the RHCP signal is allowed to make a half-rotation, which causes an inversion of the orthogonal electric field components, $E_x$ and $E_y$, of the RHCP signal. Thenceforth, the vertical septum 26 functions in a manner equivalent to a combined orthomode transducer/polarizer to convert the RHCP signal into a horizontally polarized signal outputted through the output port D, with the E-field vector of the output signal present at output port D being oriented in the opposite direction with respect to the E-field vector of the output signal present at output port C, thereby facilitating substantially interference-free, dual mode operation.

Figure 6:
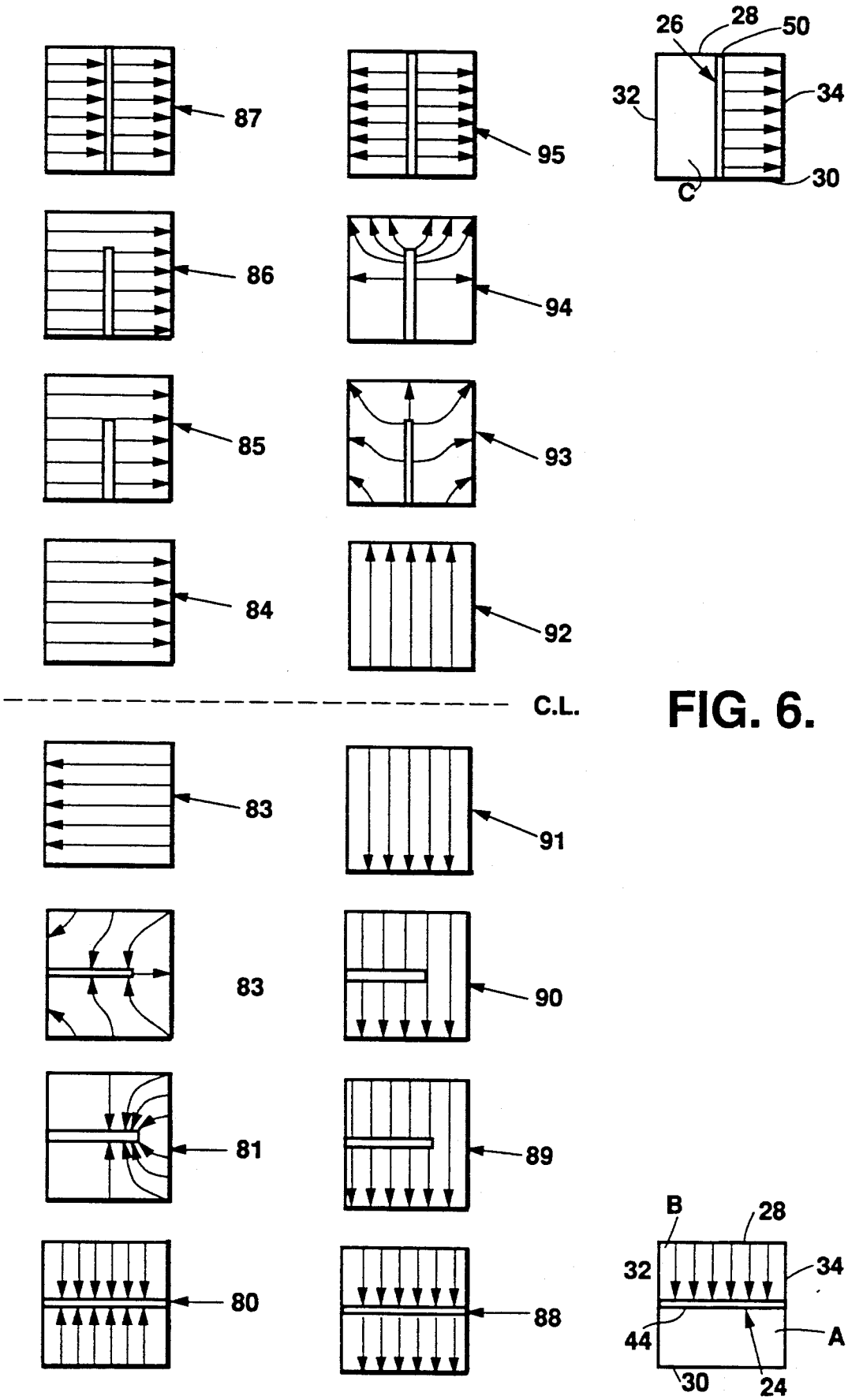
FIG. 6 illustrates the electric field vectors of a horizontally polarized signal introduced into the input port B of the rotator shown in FIGS. 1 and 2, in successive planes spaced along and perpendicular to the longitudinal axis of the rotator waveguide, corresponding to successive stages of progression of the signal as it propagates through the rotator waveguide from input port B towards output port D.

The operation of the polarization rotator 20 of the present invention described in general terms above will now be described more specifically with reference to FIGS. 5 and 6, which illustrate electric field vectors of the first and second microwave input signals, respectively, in successive planes spaced along and perpendicular to the longitudinal axis of the waveguide 22. More particularly, FIG. 5 depicts the electric field vectors (represented by arrows) of a vertically polarized signal introduced into the input port A, at several stages of its progression through the waveguide 22, as it propagates from input port A towards output port C. FIG. 6 depicts the electric field vectors (represented by arrows) of a horizontally polarized signal introduced into the input port B, at several stages of its progression through the waveguide 22, as it propagates from input port B towards output port D.

Referring particularly now to FIG. 5, it can be seen that the horizontal septum 24 initially behaves like an orthomode transducer (OMT), in that the marginal edge portion 42 thereof functions to launch orthogonal modes M1 and M2 which are 90° out-of-phase with respect to each other. The vector action of mode M1 (which can be viewed as the 0° mode) is shown in the left-hand series of frames, numbered 60–67, and the vector action of mode M2 (which can be viewed as the 90° mode) is shown in the right-hand series of frames, numbered 68–75.

More particularly, as can be seen in first corresponding frames 60, 68, the vertically polarized signal which excites input port A is transformed into its electric field components $E_x$ and $E_y$, which are represented by the vectors or field lines (depicted by arrows) for modes M1 and M2, respectively. Specifically, the frame 60 illustrates the effect of the marginal edge portion 42 of the horizontal septum 24 on the $E_x$ electric field component of the vertically polarized input/excitation signal, which is to divide the $E_x$ field lines into two oppositely directed vertical portions (in directions away from each other) disposed on opposite sides of the horizontal septum 24. On the other hand, the frames 68–71 illustrate the fact that as the $E_y$ electric field component progresses through the horizontal septum portion of the waveguide 22, its direction remains unchanged, and thus, as can be seen in frame 71, arrives at the non-septum portion 54 of the waveguide 22 with its field lines directed vertically downwardly, just as in frame 68. In other words, the horizontal septum 24 is transparent to the $E_y$ electric field component of the vertically polarized input signal. As can be seen in frames 61 and 62, the $E_x$ electric field component field lines are progressively distorted by the horizontal septum 24 until they are converted into horizontally rightwardly directed field lines at the non-septum portion 54 of the waveguide 22, as is shown in frame 63, 90° out-of-phase with the vertically downwardly directed field lines of the $E_y$ electric field component shown in frame 71. Thus, since the signal present in the non-septum portion 54 of the waveguide 22 is the vector resultant of the $E_x$ and $E_y$ electric field components, then it can be readily appreciated that the signal propagating through the non-septum portion 54 of the waveguide 22 is a left-hand circularly polarized (LHCP) signal. As is shown in the next corresponding frames 64, 72, on the opposite side of waveguide cross-sectional centerline C.L., the directions of the $E_x$ and $E_y$ electric field component field lines are inverted with respect to their respective directions shown in the previous corresponding frames 63, 71. As is shown in frames 65–67, the vertical septum 26 is transparent to the now leftwardly horizontally directed field lines of the $E_x$ electric field component of the signal propagating through the vertical septum portion of the waveguide 22, and thus remain intact/unchanged at output ports C and D, as is shown in frame 67. On the other hand, as is illustrated in frames 73 and 74, the $E_y$ electric field component field lines are progressively distorted by the vertical septum 26, until they are converted into oppositely directed horizontal field lines at the output ports C and D, as is shown in frame 75. Thus, the field lines present at output port C are additive, and the field lines present at output port D are annulingly subtractive, in accordance with basic principles of vector mathematics, thereby presenting a horizontally polarized signal at output port C.

Referring particularly now to FIG. 6, it can be seen that the horizontal septum 24 initially behaves like an orthogonal mode transducer (OMT), in that the marginal edge portion 42 thereof functions to launch orthogonal modes M3 and M4 which are 90° outof-phase with respect to each other. The vector action of the mode M3 (which can be viewed as the 0° mode) is shown in the left-hand series of frames, numbered 80–87, and the vector action of the mode M4 (which can be viewed as the 90° mode) is shown in the right-hand series of frames, numbered 88–95.

More particularly, as can be seen in first corresponding frames 80, 88, the horizontally polarized signal which excites input port B is transformed into its electric field components, $E_x$ and $E_y$, which are represented by the vectors or field lines (depicted by arrows) for modes M3 and M4, respectively. Specifically, the frame 80 illustrates the effect of the marginal edge portion 42 of the horizontal septum 24 on the $E_x$ electric field component of the horizontally polarized input/excitation signal, which is to divide the $E_x$ field lines into two oppositely directed vertical portions (in directions towards each other), on opposite sides of the horizontal septum 24. On the other hand, the frames 88–90 illustrate the fact that as the $E_y$ field component progresses through the horizontal septum portion of the waveguide 22, its direction remains unchanged, and thus, as can be seen in frame 91, arrives at the non-septum portion 54 of the waveguide 22 with its field lines directed vertically downwardly, just as in frame 88. In other words, the horizontal septum 24 is transparent to the $E_y$ electric field component of the horizontally polarized input signal. As can be seen in frames 81 and 82, the $E_x$ electric field component field lines are progressively distorted, until they are converted into horizontally leftwardly directed field lines at the non-septum portion 54 of the waveguide 22, as is shown in frame 83, 90° out-of-phase with the vertically downwardly directed field lines of the $E_y$ electric field component shown in frame 91. Thus, since the signal present in the non-septum portion 54 of the waveguide 22 is the vector resultant of the $E_x$ and $E_y$ electric field components, then it can be readily appreciated that the signal propagating through the non-septum portion 54 of the waveguide 22 is a right-hand circularly polarized (RHCP) signal. As is shown in the next corresponding frames 84, 92, on the opposite side of the waveguide cross-sectional centerline C.L., the directions of the $E_x$ and $E_y$ electric field conmponent field lines are inverted with respect to their respective directions shown in the previous corresponding frames 83, 91. As is shown in frames 85–87, the vertical septum 26 is transparent to the now rightwardly horizontally directed field lines of the $E_x$ electric field ocmponent of the signal propagating through the vertical septum portion of the waveguide 22, and thus remain intact/unchanged at output ports C and D, as is shown in frame 87. On the other hand, as is illustrated in frames 93 and 94, the $E_y$ electric field component field lines are progressively distorted by the vertical septum 26, until they are converted into oppositely directed horizontal field lines at the output ports C and D, as is shown in frame 95. Thus, the field lines present at output port D are additive, and the field lines present at output port C are annulingly subtractive, in accordance with basic principles of vector mathematics, thereby presenting a horizontally polarized signal at output port D. Moreover, with reference now to both FIGS. 5 and 6, it can be seen that the E-field vectors of the horizontally polarized output signals present at output ports C and D are pointed in opposite directions (i.e. 180° apart), and thus, do not interfere with each other. Consequently, it can be readily appreciated that the polarization rotator 20 of the present invention can be operated in dual mode (i.e. with signals in the same frequency band, e.g., the Ku band, present at both output ports simultaneously), with minimal return loss and maximum isolation. The dual signals may suitably constitute separate information channels. Accordingly, this aspect of the present invention renders it particularly advantageous in applications such as power division, signal distribution, beam forming, and signal feed networks, e.g. such as are employed in phased array antenna system utilized in telecommunications satellites.

Although not limiting to the above-described generic inventive concepts, features, and principles of the present invention, the dimensions of the polarization rotator 20 are most preferably as set forth below, in order to optimize the signal-handling characteristics (e.g. polarization purity, signal isolation, return losses, etc.). These preferred dimensions will be defined in terms of scaling factors which are expressed in terms of a multiplier constant, and a multiplicand variable which is equal to the freespace wavelength WV of the RF input/excitation signal. Accordingly, the preferred dimensions are as follows: the overall length dimension L of the waveguide 22 is approximately 3.59 WV; the internal cross-section, CS, of the waveguide 22 is approximately 0.626 WV square, whereby the input ports A,B are approximately 0.313 WV high by 0.626 WV wide, and the output ports C,D are approximately 0.626 WV high by 0.313 WV wide; each of the septums 24, 26 preferably has four steps of uniform size, with each of the steps having a length of approximately 0.25 WVG, and the overall length dimension L1 of each septum being approximately 1.545 WV, where WVG is the characteristic wavelength of the waveguide; and, as previously mentioned, the length, L2 of the nonseptum portion 54 of the waveguide 22 is approximately 0.5 WV. Additionally, the septums 24, 26 are made as thin as possible for a given application. Accordingly, it is preferred that the thickness T of the septums 24, 26 be in the range of 0.020"-0.040". In a prototypical polarization rotator constructed in accordance with these scaling factors, and designed to operate in the Ku microwave frequency band, the above-defined dimensions were as follows: L=3.4"; CS=0.593" square; L1=1.463"; L2=0.474"; and, T=0.030". This prototypical rotator exhibited superior electrical performance, e.g., insertion loss of approximately −0.34 dB; dual mode output isolation of approximately −35 dB; return loss of better than 35 dB down; and isolation of better than 20 dB down at Ku band. However, it should be clearly understood that the actual optimum dimensions will vary depending upon the specific application in which the present invention is employed, and the specified operating parameters therefor, since some applications generally place greater importance on certain performance parameters and less on others, e.g., low ellipticity and high isolation might be more important than wide bandwidth or vice-versa.

Moreover, although the present invention has been described in some detail and in the specific context of preferred and actual embodiments thereof, it should be clearly understood that various modifications and embodiments of which may appear to those skilled in the art will still fall within the spirit and scope of the broader generic inventive concepts herein taught. For example, although the septums 24, 26 have been described as stepped septums, it should be clearly understood that the particular construction of the septums is not limiting to the present invention in its broadest sense, and that any other convenient type of septum polarizer such as are well-known in the art may be utilized in lieu thereof. Broadly speaking, any septum which is capable of transforming circular polarization into linear polarization, and vice versa, may be utilized in the practice of the present invention, e.g., sloped septums having straight, planar slope edges, or sloped septums having slope edges which are characterized by any suitable number of gradual and/or abrupt discontinuites therealong. It is believed that the only essential requirement for the septum be that its width generally decrease in a direction from the outside towards the central interior of the waveguide. In general though, the stepped septum is believed to provide better isolation over a wider bandwidth than can be obtained with a sloped septum. Further, a circular or other suitable form of waveguide may be utilized in place of the square waveguide described in conjunction with the preferred embodiment of the present invention, the only requirement for purposes of the instant invention being that the waveguide be capable of supporting signal propagation of circular and linear polarizations. Accordingly, the present invention should not be limited to the specific embodiments disclosed herein, but rather, should be accorded the broadest scope consistent with the principles and features disclosed herein.

What is claimed is:

1. A dual septum polarization rotator, comprising:

a waveguide capable of supporting signal propagation of circular and linear polarizations, and having a longitudinal axis;

a first septum disposed within a first end portion of said waveguide, and defining, in cooperation with said waveguide, first and second input ports, wherein said first septum is adapted to convert the polarization of a first excitation signal introduced into said first input port from a first polarization to a second polarization; and, a second septum disposed within a second end portion of said waveguide opposite said first end portion, and in spaced, orthogonal relationship to said first septum, said second septum defining, in cooperation with said waveguide, first and second output ports corresponding to said first and second input ports, respectively, wherein said second septum is adapted to convert the polarization of said first excitation signal from said second polarization to a third polarization orthogonal to said first polarization, for output through said first output port, as a first output signal.

2. The rotator as set forth in claim 1, wherein said waveguide comprises a square waveguide having a pair of parallel, opposed, electrically conductive, side walls, and parallel, opposed, electrically conductive, top and bottom walls, joined together along their longitudinal edges.

3. The rotator as set forth in claim 2, wherein:

said first septum extends horizontally across the interior of said waveguide between said side walls, and parallel to said top and bottom walls thereof;

said second septum extends vertically across the interior of said waveguide between said top and bottom walls, and parallel to said side walls thereof; and, said first and said second septums are spaced-apart to define an open, central, nonseptum region in the interior of said waveguide.

4. The rotator as set forth in claim 3, wherein the horizontal dimension of said first septum decreases in a first direction from said first end portion towards said nonseptum portion of said waveguide, and the vertical dimension of said second septum decreases in a second direction from said second end portion towards said nonseptum portion of said waveguide.

5. The rotator as set forth in claim 4, wherein said first and said second septums each comprise a sloped septum having an edge which is sloped along the longitudinal axis of said waveguide.

6. The rotator as set forth in claim 5, wherein said sloped edge of each of said sloped septums includes at least one discontinuity provided therealong.

7. The rotator as set forth in claim 4, wherein said first septum includes a plurality of first steps descending in said first direction, and said second septum includes a plurality of second steps descending in said second direction.

8. The rotator as set forth in claim 7, wherein:

said first septum includes an outermost marginal edge portion which extends completely across the interior width of said waveguide to interconnect said side walls thereof, substantially halfway between said top and bottom walls; and, said second septum includes an outermost marginal edge portion which extends completely across the interior height of said waveguide to interconnect said top and bottom walls thereof, substantially halfway between said side walls.

9. The rotator as set forth in claim 3, wherein:

said first excitation signal has a prescribed wavelength, defined as WV; and, the overall length dimension of said waveguide is approximately 3.59 WV.

10. The rotator as set forth in claim 9, wherein the internal cross-section, defined as CS, of said waveguide is approximately 0.626 WV square.

11. The rotator as set forth in claim 7, wherein said first steps and said second steps each have substantially uniform dimensions.

12. The rotator as set forth in claim 11, wherein said first septum includes four of said first steps, and said second septum includes four of said second steps, with said first steps and said second steps each having a length which is approximately $\frac{1}{4}$ of the characteristic wavelength of said waveguide.

13. The rotator as set forth in claim 10, wherein said first septum and said second septum each have an overall length dimension that is approximately 1.545 WV.

14. The rotator as set forth in claim 4, wherein:

said first polarization is vertical polarization;

said second polarization is left-hand circular polarization; and, said third polarization is horizontal polarization.

15. The rotator as set forth in claim 4, wherein:

said first septum is further adapted to convert the polarization of a second excitation signal introduced into said second input port from a fourth polarization to a fifth polarization; and, said second septum is further adapted to convert the polarization of said second excitation signal from said fifth polarization to a sixth polarization orthogonal to said fourth polarization, for output through said second output port, as a second output signal.

16. The rotator as set forth in claim 15, wherein said fourth polarization is vertical polarization, said fifth polarization is right-hand circular polarization, and said sixth polarization is horizontal polarization.

17. The rotator as set forth in claim 15, wherein:

said third polarization and said sixth polarization share a common plane; and, said first output signal and said second output signal have E-field vectors which are pointed in opposite directions.

18. The rotator as set forth in claim 15, wherein said rotator is capable of dual mode operation, whereby said first and said second output signals appear simultaneously at said first and said second output ports, respectively.

19. The rotator as set forth in claim 18, wherein said first and said second excitation signals are microwave signals.

20. The rotator as set forth in claim 19, wherein said microwave signals are both in the same frequency band.

* * * * *